US005295820A

United States Patent [19]

Bilcik et al.

[11] Patent Number: 5,295,820

[45] Date of Patent: Mar. 22, 1994

[54] LINEAR BURNER

[75] Inventors: Yves Bilcik, Crepy En Valois; Jean-Jacques Chasseing, Mouy; Jean-Marie Gobaille, Le Blanc Mesnil; Dominique Teillay, Mitry Mory, all of France

[73] Assignees: Gaz de France, Paris; Alsace Gaz Industrie, Vieux Thann, both of France

[21] Appl. No.: 864,586

[22] Filed: Apr. 7, 1992

[30] Foreign Application Priority Data

Apr. 15, 1991 [FR] France ..... 91 04570

[51] Int. Cl.[5] ..... F23K 5/06

[52] U.S. Cl. ..... 431/280; 431/281; 239/563; 239/566; 137/624.11

[58] Field of Search ..... 431/278, 280, 281, 12; 239/581.1, 562, 563, 566; 137/625.11, 625.12, 625.13

[56] References Cited

U.S. PATENT DOCUMENTS

| | | | |
|---|---|---|---|
| 705,581 | 7/1902 | Harper | 239/563 |
| 1,776,546 | 4/1930 | Carrington | 239/581.1 X |
| 4,614,491 | 9/1986 | Welden | 431/281 X |
| 4,932,232 | 6/1990 | Ballyns et al. | 239/563 X |
| 5,094,612 | 3/1992 | Vallat | 431/280 |

FOREIGN PATENT DOCUMENTS

| | | | |
|---|---|---|---|
| 2745687 | 4/1979 | Fed. Rep. of Germany | 431/278 |
| 2234817 | 1/1975 | France . | |
| 2641601 | 7/1990 | France . | |
| 498774 | 1/1939 | United Kingdom | 239/562 |

*Primary Examiner*—Carl D. Price
*Attorney, Agent, or Firm*—Thomas R. Morrison

[57] ABSTRACT

The invention relates to a linear burner with jets extending through an opening made in a wall of a body of the burner defining an air-distribution chamber. According to the invention, the jets are connected to a series of tubes for supplying fuel gas or a gas/air mixture, these tubes passing through the body of the burner in order to be connected on the outside to a distribution housing provided with gas or with a gas/air mixture, this housing comprising adjustment means for selectively supplying the tubes joined to the jets.

8 Claims, 3 Drawing Sheets

FIG_1
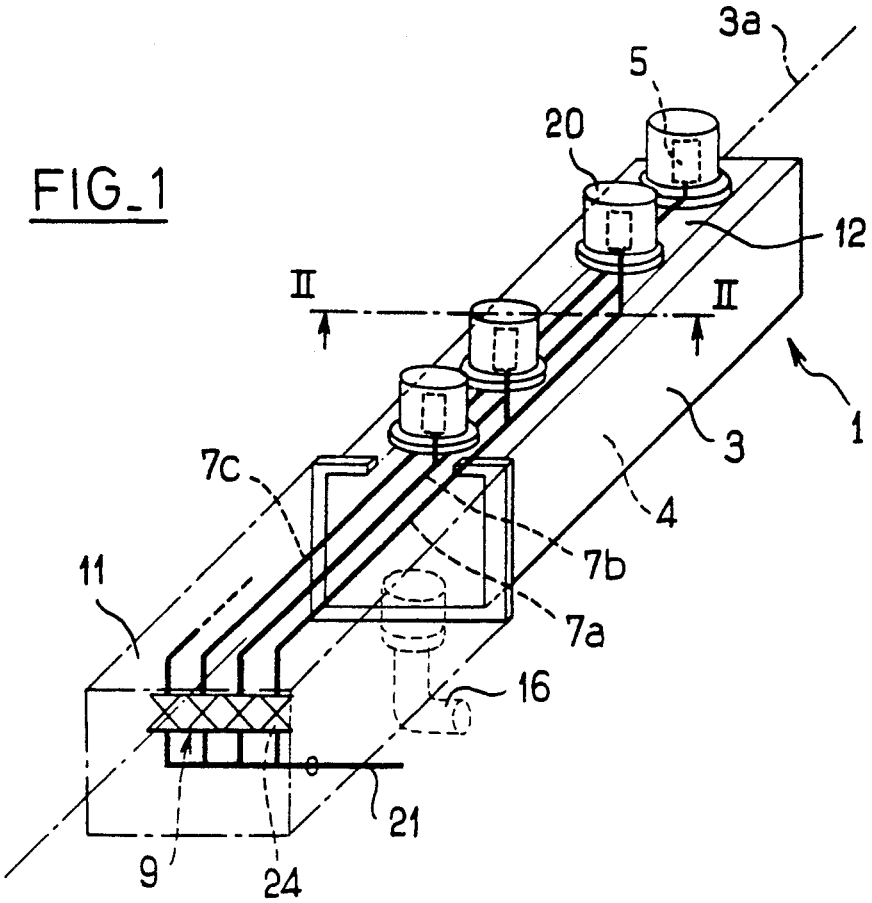
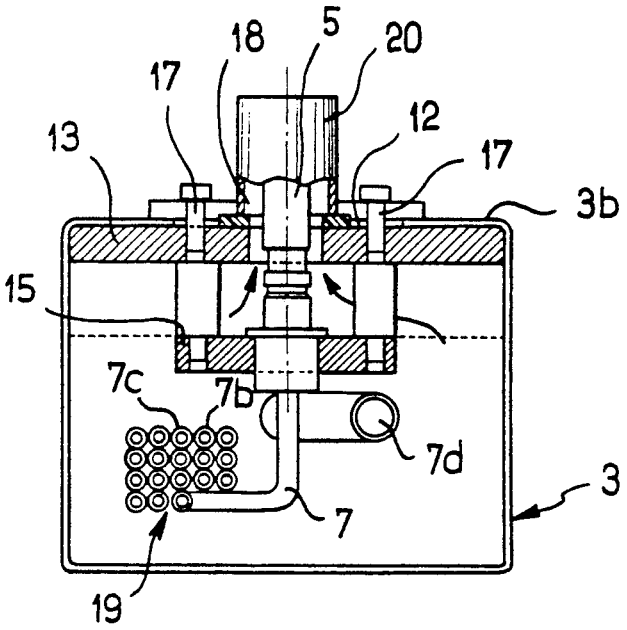
FIG_2

FIG_3
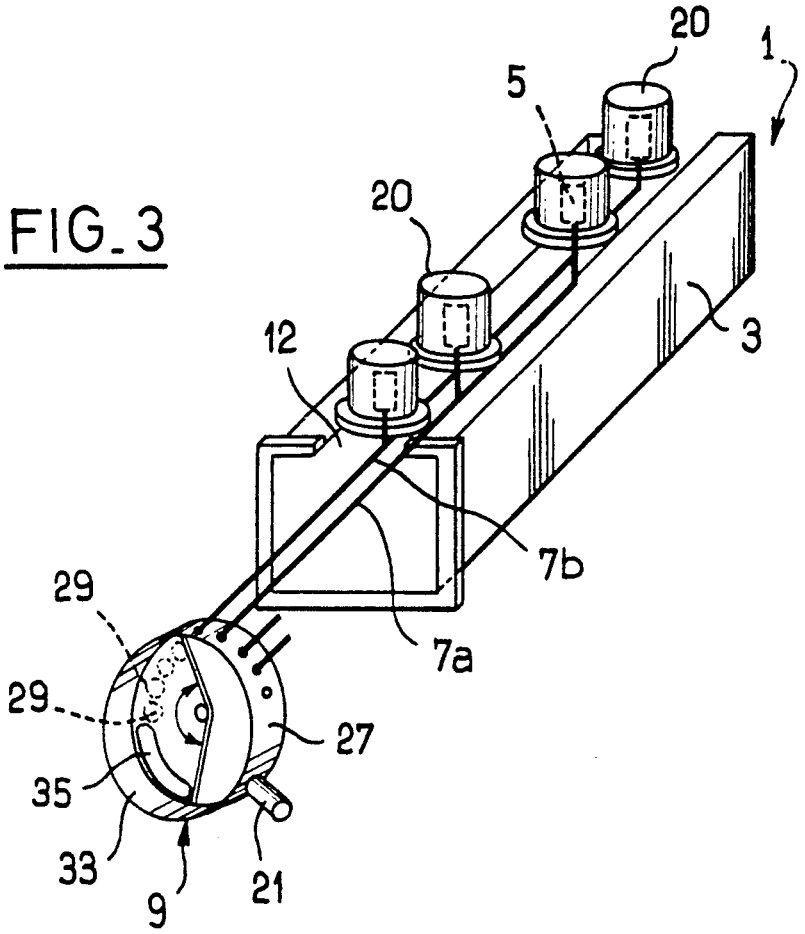
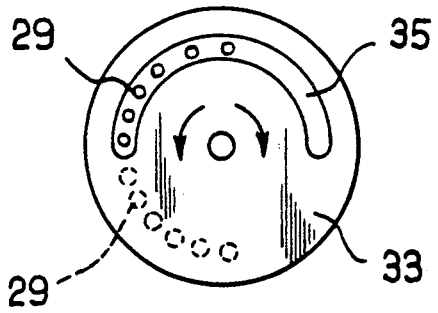
FIG_4

LINEAR BURNER

BACKGROUND OF THE INVENTION

The invention relates to a linear burner supplied with fuel gas and oxygen-carrying air.

In the field, such a burner is also referred to as a burner rail.

An example of a burner of this type may be found in Patent Application FR 2,641,601 or WO-a-900 7680.

This is a burner comprising at least one row of jets, each jet extending through an opening made in a wall of a body of the burner forming an air-distribution chamber on the inside, with which the said jets communicate, these jets being arranged substantially radially relative to a longitudinal direction in which the body of this burner extends.

This type of burner has the advantage of offering a very extensive range of heating power.

Its use is widespread particularly in the food industry.

It permits good distribution of the heating zone and, a priori, a relatively accurate possible adjustment of the power, bearing in mind the multiplication of the jets and their distribution.

In order to enhance variation of the working width of the burner, that is to say to adapt the number of jets which have to operate to the heating requirements, the abovementioned publication WO-A-900 7680 proposes mechanically varying the volume of the body of the burner so as to connect a larger or smaller number of jets to the supplies provided for this purpose.

Such mechanical adjustment using moving pieces does, however, present certain disadvantages linked particularly to problems of leaktightness and, if appropriate, mechanical behavior of the drive pieces, the pistons provided for this purpose being capable, in particular, of becoming immobilized.

Moreover, on the burner in question, it may be difficult to know the useful clear volume of the body of the burner and thus the available heating power. Furthermore, under certain conditions, flame instability could occur, drops in pressure proving to be unequally distributed inside the body.

It will also be noted that such an apparatus requires the production of an assembly comprising a large number of pieces and, particularly, the presence not only of an air-distribution chamber but also, arranged inside, of a fuel gas distribution chamber, the jets then being supplied "globally" via this second chamber.

OBJECTS AND SUMMARY OF THE INVENTION

The particular object of the invention is to solve the abovementioned problems by proposing a burner which, on the body of the burner, does not have a gas distribution chamber and mechanical members for controlling the number of jets which are to be supplied, thus enabling general operation and system reliability to be improved whilst reducing the manufacturing costs thereof.

More precisely, the burner of the invention is characterized in that the jets with which it is equipped are connected individually or in groups to a series of tubes for supplying fuel gas or a mixture of fuel gas and air, these tubes passing through the body of the burner in order to be connected on the outside to a distribution housing which is itself connected to a main supply duct in which fuel gas or a mixture of fuel gas and air circulates, this housing comprising adjustment means for selectively supplying, totally or partially, the said supply tubes joined to the jets.

Thus, the body of the burner, that is to say its structure, encloses only an air-distribution chamber without a fuel gas distribution chamber.

Advantageously, this burner body may also have the form of a pipe or channel of substantially rectangular or square cross-section in which a slot extending in the longitudinal direction of the body is made, and through which the jets will project.

According to a further characteristic of the invention, the adjustment means with which the distribution housing adjacent to the body of the burner is equipped may consist of metering means for metering the supply of fuel gas or fuel gas/air mixture of at least some of the jets.

For the embodiment of the adjustment means, amongst others which may be envisaged, two, in particular, have been adopted, namely a solenoid valve system and a sliding-sector system permitting closing off or uncovering of a series of orifices joined to the supply tubes of the jets.

Of course, with respect to an aim both for compactness and reliability, without excessive cost, the arrangement of the distribution housing beside the body of the burner to which the housing will be fixed by a flange appears to be a highly favorable solution.

Other features and advantages of the invention will also become apparent from the following description which is made with reference to the appended drawings given by way of non-limiting examples, and in which:

BRIEF DESCRIPTION OF THE DRAWINGS

FIG. 1 is a diagrammatic view of a first embodiment of a linear burner according to the invention, FIG. 2 is a sectional view in the direction of the line II—II in FIG. 1, FIG. 3 is also a diagrammatic view in perspective of an alternative embodiment of the burner in FIG. 1, FIG. 4 is a diagrammatic view illustrating the operating principle of the adjustment means used on the burner in FIG. 3 for the selective supply of the supply tubes joined to the jets.

DETAILED DESCRIPTION OF THE PREFERRED EMBODIMENT

Figure 5:
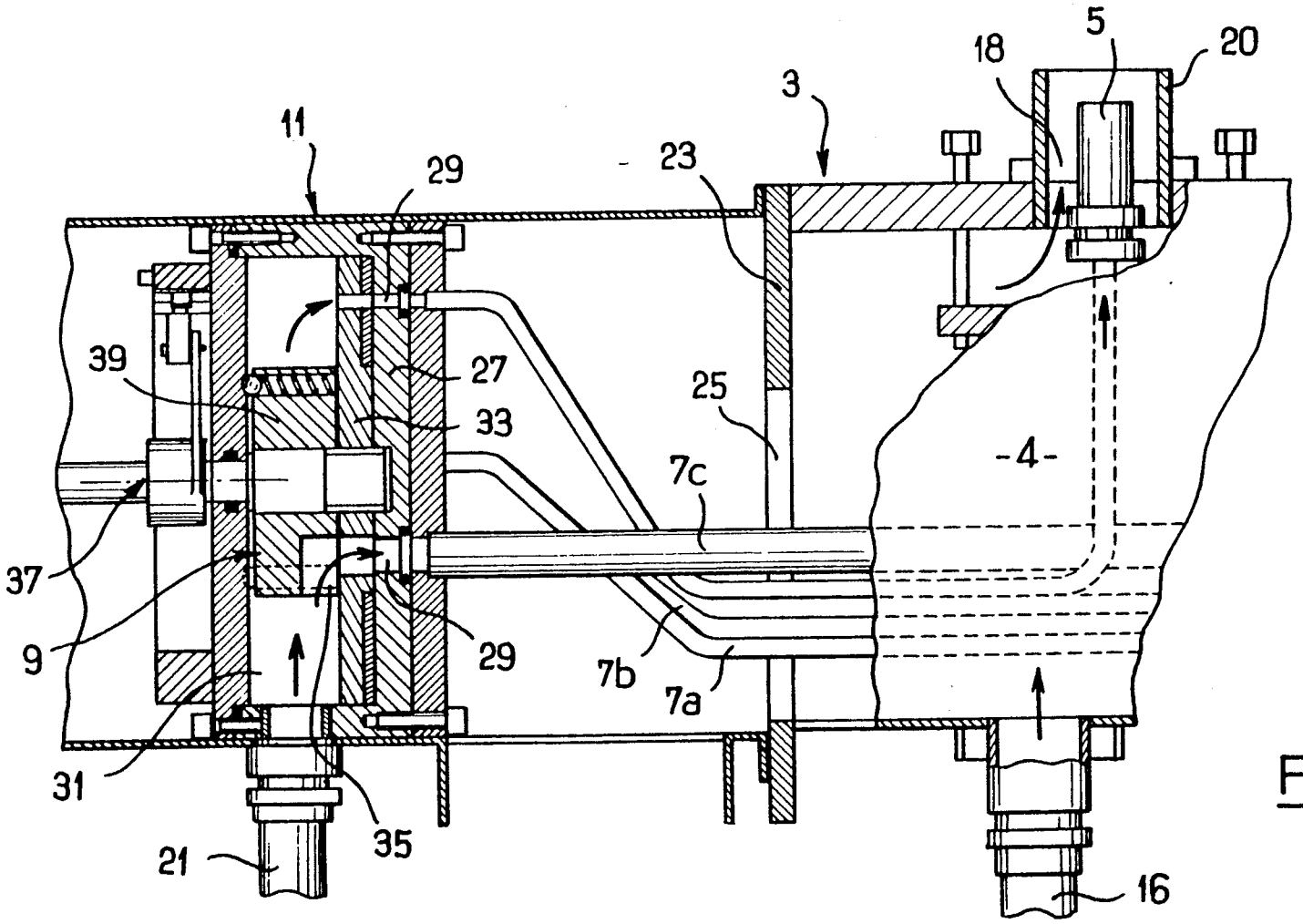
FIG. 5 is a local view in longitudinal transverse section of a technically possible embodiment of the burner, illustrated diagrammatically in FIG. 3.

Firstly, in FIG. 1, it is thus possible to see the illustration of a linear burner 1 according to the invention, comprising an elongated body or structure 3 defining, on the inside, an air-distribution chamber 4 intended to supply with (primary or secondary) air a series of jets indicated diagrammatically at 5 and which are themselves supplied with fuel gas or a fuel gas/air mixture via a network of tubes *7a, 7b, 7c*... joined, outside the body 3, to adjustment means denoted 9 overall and intended to selectively supply, totally or partially, the said supply tubes of the jets.

The adjustment means 9 are housed in a distribution housing 11 laterally adjacent to the body 3 and shown in broken lines.

Conventionally, the jets 5 are distributed in arrays forming, in this particular case, a single row or line extending in the longitudinal direction *3a* of the body 3.

As illustrated, the body 3 in question may advantageously have the form of a metal channel or pipe of substantially rectangular or square cross-section, with a longitudinal slot 12 provided for the passage of the jets and their fitting onto the body, the inner volume 4 of this body being adapted in order to form a suitable "air box".

According to the type of supply adopted, the body 3 may either be open at its opposing longitudinal ends (see FIG. 3) for an atmospheric-air supply, or closed at these said ends and then joined to a blast-air supply duct (pressurized air) indicated diagrammatically at 16 in FIGS. 1 and 5 and opening out into the volume 4. In both cases, the jets will, of course, communicate in a conventional manner with this inner volume 4 via a peripheral air passage 18 formed at the level of the slot 12, inside an air-injection ring or cone 20 surrounding each jet (see, in particular, FIGS. 2 and 5).

As may be seen more clearly in FIG. 2, these jets are here fastened radially inside the body 3 by flanges 13, 15 and fastening screws 17, so as to pass through an upper wall 3*b* of this body, through the long slot 12 provided in the longitudinal direction 3*a* of the body.

In this FIG. 2, it will be noted that the jet illustrated is connected, inside the body, to one of the supply tubes denoted *7a*, the other jets in the row being themselves either connected individually to other identical supply tubes *7b*, *7c*... joined together in a layer 19, or connected as a group to a supply tube of larger diameter, such as *7d*, the connection principle adopted being a function of the area of application of the burner and of the degree of adjustment of the power which is desired for the injectors considered individually or in small groups. It will, moreover, be noted in this respect, in FIG. 1, that if the first and fourth jets are supplied individually by the tubes *7b* and *7c*, the second and third are, on the other hand, supplied in common by the tubes *7a* and *7b*. (In FIG. 3, a further supply principle has also been envisaged).

Inside the housing 11, the tubes *7a*, *7b*... are themselves connected to a general fuel gas or fuel gas/air mixture supply pipe 21.

As illustrated in FIGS. 1, 3 and 5, the distribution housing 11 will preferably be fastened laterally to a longitudinal end of the body 3, via a fastening flange 23 in which a passage 25 for the supply hoses *7a*, *7b*... will have been provided (see FIG. 5).

The adjustment means 9, whose role, as stated, is to permit selective supplying, totally or partially, of the supply tubes joined to the jets, from the outside of the body of the burner, may have various forms. However, it is advisable to choose means which permit the metering of the fuel gas or gas/air mixture supply to at least some of these jets.

Two illustrative embodiments have been shown in the figures.

Firstly, in FIG. 1, these means consist of a series of solenoid valves 24 interposed inside the volume of the housing 11 on each supply tube *7a*, *7b*..., downstream of their common connection to the general duct 21.

These solenoid valves may, of course, be joined to any customary monitoring and control system, particularly via an automatic electronic control housing (not shown).

In FIGS. 3 to 5, the adjustment means in question have been replaced by a sliding-sector system comprising a fixed piece 27 in the thickness of which are locally formed orifices 29 which are at least equal in number to the number of supply tubes *7a*, *7b*... to which these orifices are connected on one side, communicating, on the other side, with the general supply duct 21, via a distribution chamber 31 (see FIG. 5).

A movable piece 33, having a slot 35 right through its thickness, slides, for example in rotation, in contact with and opposite the fixed piece 27 (see FIGS. 3 and 4), such that it can cover in a gastight manner or uncover all or part of the orifices 29 of the fixed piece 27, by movement of the movable part.

As may be seen more clearly in FIGS. 3 and 4, this movable part 33 may have the form of a rotating sector having a slot 35 in the form of an arc of a circle, the orifices 29 of the fixed piece 27 then being, correspondingly, also provided in an arc of a circle.

In FIG. 5, it will also be noted that there is a control rod assembly 37 which can be actuated from outside the housing in order to move the movable piece 33, via a mechanism plate 39.

We claim:

1. A linear burner comprising an elongated air box, said air box having outer walls defining a substantially rectangular cross section, one outer wall having a slot therethrough extending longitudinally of the air box, an air supply aperture made through another of said outer walls for supplying air to the air box, a series of burner jets extending through said slot and communicating with said air box for being supplied with air therefrom, said jets being further connected to a series of gas supply tubes extending through said air box, and gas distribution means connected on a first side to a main supply of a fuel gas and on a second side to said series of supply tubes for selectively providing said supply tubes with said fuel gas.

2. A linear burner according to claim 1 wherein said air supply aperture is connected to a supply of air under pressure.

3. A linear burner according to claim 9 wherein said gas distribution means comprises metering means for metering said fuel gas to the supply tubes.

4. A linear burner according to claim 1 wherein said burner jets are each surrounded by an air diffusing ring leaving a space around the corresponding jet, said space communicating with said air box through the slot thereof.

5. A linear burner comprising an elongated air box having outer walls through at least one of which is made a series of at least one row of openings, an air supply aperture made through another of said outer walls for supplying air to the air box, a series of burner jets extending each through one of said openings and communicating with said air box for being supplied with air therefrom, said burner jets being further connected to a series of gas supply tubes extending through said air box, and a gas distribution box disposed adjacent said air box and containing gas distribution means connected on a first side to a main supply of a fuel gas and on a second side to said series of supply tubes for selectively providing said supply tubes with said fuel gas.

6. A linear burner according to claim 5 wherein said air supply aperture is connected to a supply of air under pressure.

7. A linear burner according to claim 5 wherein said openings of each row are joined all together for constituting a slot through which said burner jets pass.

8. A linear burner according to claim 5 wherein said burner jets are each surrounded by air diffusing ring leaving a space around the corresponding jet, said space communicating with said air box through the corresponding opening thereof.

* * * * *